US012357897B2

(12) United States Patent
Hempkins

(10) Patent No.: US 12,357,897 B2
(45) Date of Patent: Jul. 15, 2025

(54) GOLF PRACTICE ASSEMBLY

(71) Applicant: Kevin Hempkins, Denison, TX (US)

(72) Inventor: Kevin Hempkins, Denison, TX (US)

( * ) Notice: Subject to any disclaimer, the term of this patent is extended or adjusted under 35 U.S.C. 154(b) by 215 days.

(21) Appl. No.: 18/087,953

(22) Filed: Dec. 23, 2022

(65) Prior Publication Data

US 2024/0207708 A1 Jun. 27, 2024

(51) Int. Cl.
*A63B 69/36* (2006.01)

(52) U.S. Cl.
CPC ..... *A63B 69/3661* (2013.01); *A63B 2214/00* (2020.08)

(58) Field of Classification Search
CPC ..... A63B 69/3661; A63B 2214/00; A63B 2209/10
USPC ..... 473/157–164, 278, 279, 409
See application file for complete search history.

(56) References Cited

U.S. PATENT DOCUMENTS 3,534,961 A * 10/1970 Tiley ..... A63F 7/0628 273/284
4,630,828 A * 12/1986 Lovin ..... A63B 69/3661 473/278
5,618,131 A * 4/1997 Weber ..... E01C 13/08 404/32
D395,457 S 6/1998 Tsou
5,803,820 A 9/1998 McCarty
6,312,345 B1 * 11/2001 Pelz ..... A63B 69/3661 473/150
6,497,624 B2 12/2002 Howard
6,669,572 B1 * 12/2003 Barlow ..... E01C 13/08 473/162
8,616,467 B1 * 12/2013 Leavitt ..... B05B 15/16 239/288.5
8,852,017 B2 10/2014 Zambrello
10,315,094 B2 6/2019 Pravata
11,504,734 B1 * 11/2022 Leavitt ..... B05B 15/16
2006/0040073 A1 * 2/2006 Straughn ..... E01C 13/08 428/17
2015/0024862 A1 * 1/2015 Muller ..... A63B 57/353 473/257
2015/0118418 A1 * 4/2015 Cooley ..... B09B 1/004 428/17

FOREIGN PATENT DOCUMENTS

WO WO-0187431 A1 * 11/2001 ..... A63B 69/3652
WO WO2011065803 6/2011

* cited by examiner

*Primary Examiner* — Nini F Legesse

(57) ABSTRACT

A golf practice assembly for practicing bunker shots on a golf course includes a golf mat that has a turf portion comprised of artificial turf and a bunker portion comprised of a deformable bag. The bunker portion simulates sand in a bunker of a golf course to facilitate a golfer to practice bunker shots without traveling to a golf course. A granular material is disposed within the deformable bag thereby facilitating the deformable bag to simulate sand in the bunker of the golf course. In this way the granular material increases difficulty for the golfer to practice the bunker shots.

5 Claims, 3 Drawing Sheets

GOLF PRACTICE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

(1) Field of the Invention

The disclosure relates to golf devices and more particularly pertains to a new golf device for practicing bunker shots on a golf course. The device includes a golf mat that has a turf portion and a bunker portion. The bunker portion is defined by a deformable bag that is attached to the golf mat and a granular material that fills the deformable bag. A golf ball be placed on the deformable bag and a golfer can stand on the deformable bag to attempt to shoot the golf ball with a golf club. In this way the golfer can practice bunker shots without traveling to a golf course.

(2) Description of Related Art Including Information Disclosed Under 37 CFR 1.97 and 1.98

The prior art relates to golf devices including a golf practice device that includes a box, a liner positioned in the box, sand disposed on the liner and a golf mat extending away from the box. The prior art discloses a portable sand trap device that includes an annular cart, a curved barrier being positioned on the annular cart and a dome with an opening that is positionable over the curved barrier and the annular cart. The prior art discloses a golf ball dispenser that includes a launching mechanism that launches a golf ball onto a putting area. The prior art discloses a golf sand bunker simulator that includes beaded chains that are collected on a mat to simulate a sand bunker. The prior art discloses an ornamental design for a golf mat that includes a turf portion and a cup portion for holding a golf ball.

BRIEF SUMMARY OF THE INVENTION

An embodiment of the disclosure meets the needs presented above by generally comprising a golf mat that has a turf portion comprised of artificial turf and a bunker portion comprised of a deformable bag. The bunker portion simulates sand in a bunker of a golf course to facilitate a golfer to practice bunker shots without traveling to a golf course. A granular material is disposed within the deformable bag thereby facilitating the deformable bag to simulate sand in the bunker of the golf course. In this way the granular material increases difficulty for the golfer to practice the bunker shots.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
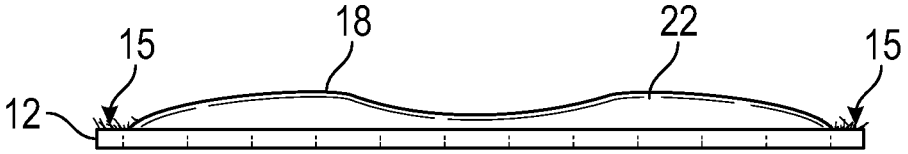
FIG. 1 is a front side view of an embodiment of the disclosure.
Figure 2:
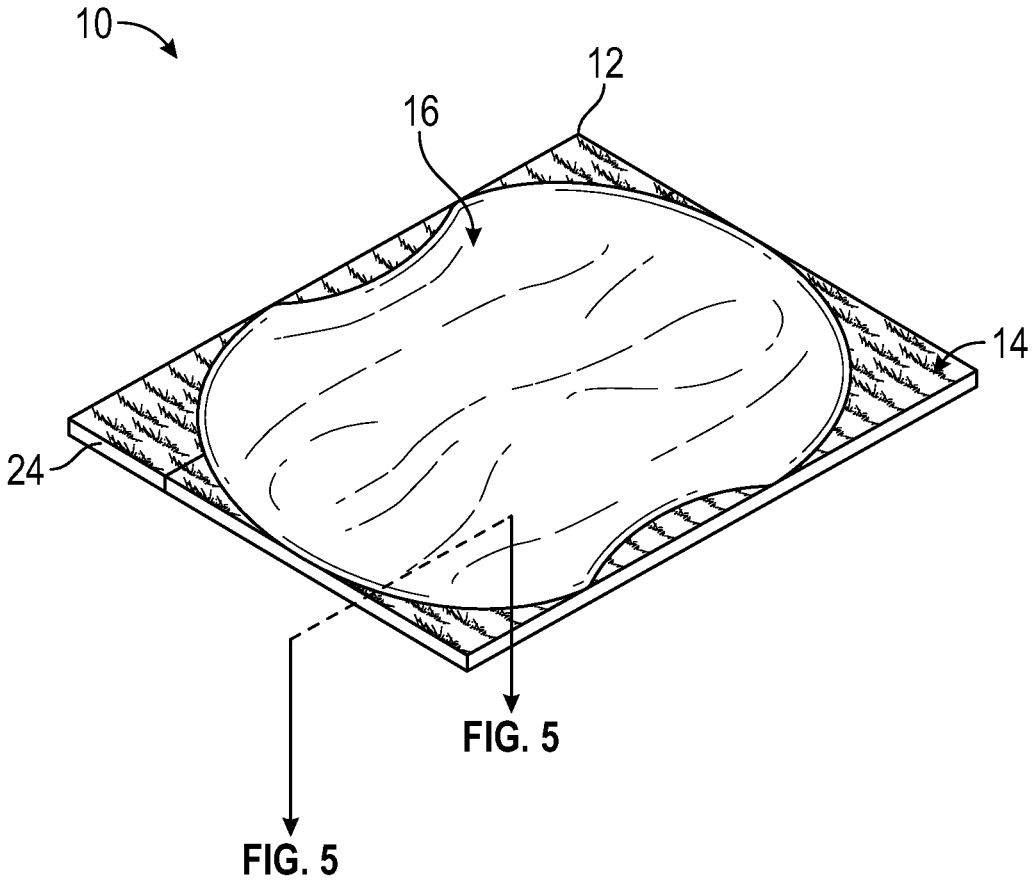
FIG. 2 is a top perspective view of a golf practice assembly according to an embodiment of the disclosure.
Figure 3:
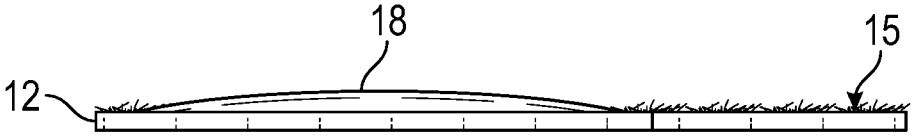
FIG. 3 is a right side view of an embodiment of the disclosure.
Figure 4:
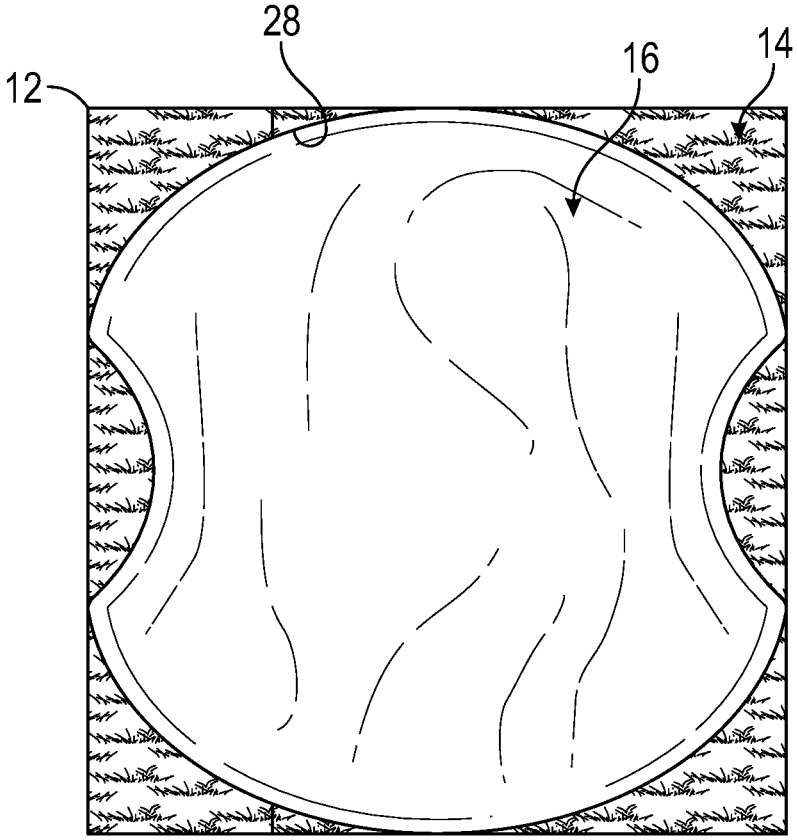
FIG. 4 is a top view of an embodiment of the disclosure.
Figure 5:
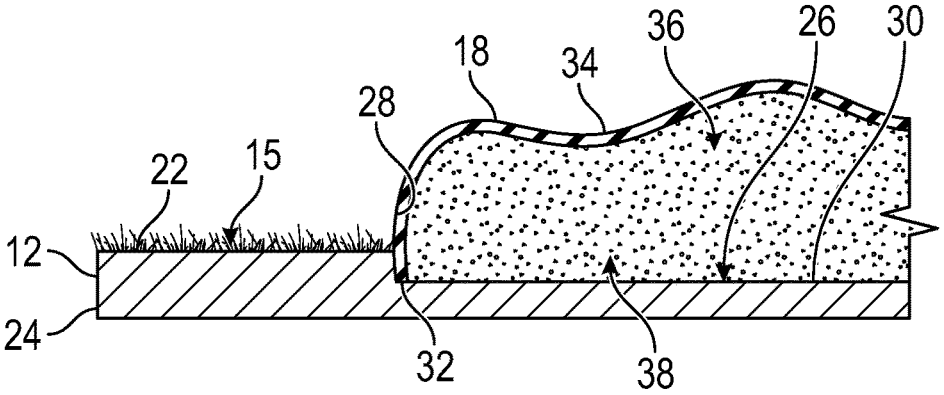
FIG. 5 is a cross sectional view taken along line 5-5 of FIG. 2 of an embodiment of the disclosure.
Figure 6:
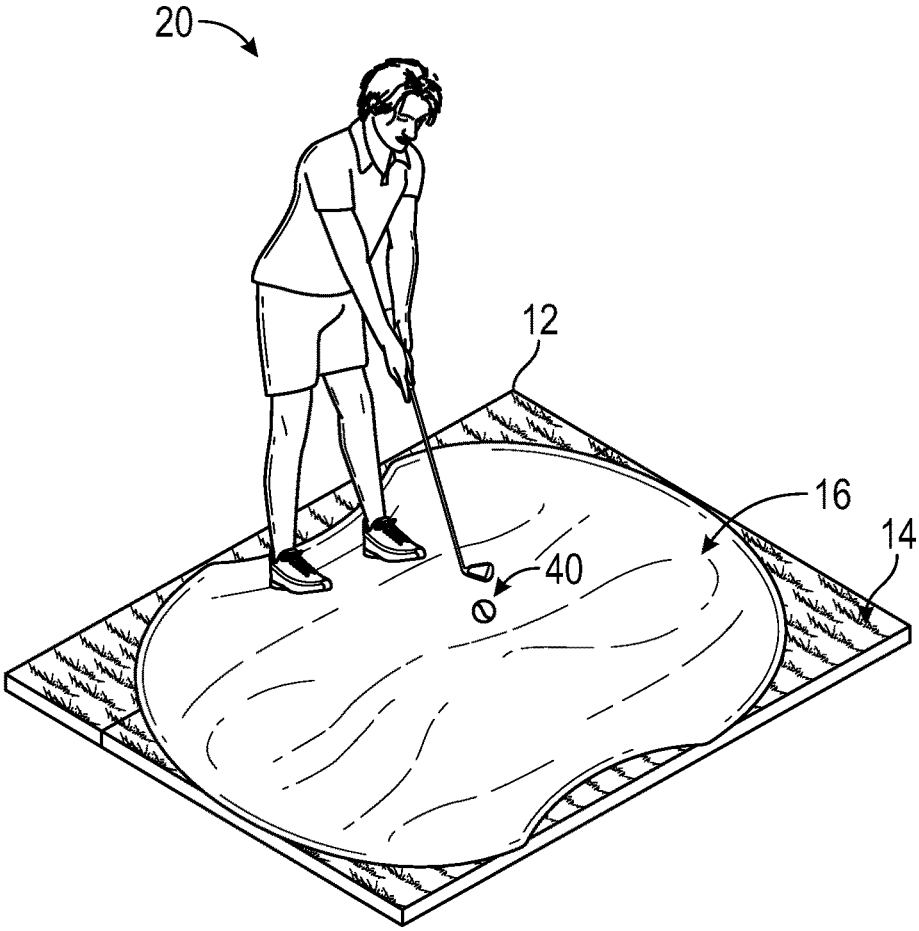
FIG. 6 is a perspective in-use view of an embodiment of the disclosure.

With reference now to the drawings, and in particular to FIGS. 1 through 6 thereof, a new golf device embodying the principles and concepts of an embodiment of the disclosure and generally designated by the reference numeral 10 will be described.

As best illustrated in FIGS. 1 through 6, the golf practice assembly 10 generally comprises a golf mat 12 that has a turf portion 14 which is comprised of artificial turf 15 and a bunker portion 16 which his comprised of a deformable bag 18 that is attached to the golf mat 12. The bunker portion 16 simulates sand in a bunker of a golf course. In this way the bunker portion 16 facilitates a golfer 20 to practice bunker shots without traveling to golf course. The golf mat 12 may have a length and a width of approximately 1.5 meters and a thickness of approximately 4.0 cm. Furthermore, the golf mat 12 may be comprised of resiliently compressible material, including but not being limited to rubber or silicone, such that the golf mat can be safely positioned on hardwood floors, for example. In this way the golf mat 12 can be employed in a home, an office or any other location the golfer 20 would regularly occupy.

The golf mat 12 has a top surface 22 and perimeter edge 24 and the golf mat 12 has a recess 26 extending into the top surface 22. The recess 26 has a bounding edge 28 and a lower bounding surface 30 and the bounding edge 28 undulates around the top surface 22 thereby facilitating the recess 26 to approximate the shape of the bunker of a golf course. The artificial turf 15 is positioned between the bounding edge 28 of the recess 26 and the perimeter edge 24 of the golf mat 12. The artificial turf 15 may be artificial turf of any conventional design that is typically associated with golf mats.

The deformable bag 18 has a perimeter edge 32 and an upper surface 34 and the perimeter edge 32 of the deformable bag 18 is attached to the lower bounding surface 30 of the recess 26. Furthermore, the perimeter edge 32 of the deformable bag 18 is aligned with the bounding edge 28 of the recess 26 such that the upper surface 34 abuts the bounding edge 28. The deformable bag 18 is comprised of a resilient material, including but not being limited to polytetrafluoroethylene, carbon fiber or canvas, which has sufficient strength to absorb the impact energy of a golf club without being damaged.

A granular material 36 is disposed within the deformable bag 18 thereby facilitating the deformable bag 18 to simulate sand in the bunker of the golf course. In this way the granular increases difficulty for the golfer 20 to practice the bunker shots. The granular material 36 fills a void 38 defined between the deformable bag 18 and the lower bounding surface 30 of the recess 26 in the top surface 22 of the golf mat 12. Additionally, the granular material 36 may comprise sand, glass beads or other type of resilient, granular material 36.

In use, the golf mat 12 is placed in a preferred location and a golf ball 40 is placed at a random location on the deformable bag 18. The golfer 20 stands on the deformable bag 18 and attempts to shoot the golf ball 40 off of the deformable bag 18 with a golf club. In this way the deformable bag 18 and the granular material 36 simulate a bunker thereby facilitating the golfer 20 to practice bunker shots without travelling to a golf course. The golf mat 12 can be rolled up for storage when the golf mat 12 is not being employed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf practice assembly for simulating a bunker shot in the game of golf, said assembly comprising;

a golf mat having a turf portion comprised of artificial turf and a bunker portion comprised of a deformable bag being attached to said golf mat thereby facilitating said bunker portion to simulate sand in a bunker of a golf course wherein said bunker portion is configured to facilitate a golfer to practice a bunker shot without traveling to a golf course;

a granular material being disposed within said deformable bag thereby facilitating said deformable bag to simulate sand in the bunker of the golf course wherein said granular material is configured to increase difficulty for the golfer to practice the bunker shot;

said golf mat has a top surface and perimeter edge, golf mat having a recess extending into said top surface, said recess having a bounding edge and a lower bounding surface, said bounding edge undulating around said top surface thereby facilitating said recess to approximate the shape of the bunker of a golf course; and said artificial turf is positioned between said bounding edge of said recess and said perimeter edge of said golf mat.

2. The assembly according to claim 1, wherein said deformable bag has a perimeter edge and an upper surface, said perimeter edge of said deformable bag being attached to said lower bounding surface of said recess having said perimeter edge being aligned with said bounding edge of said recess such that said upper surface abuts said bounding edge.

3. The assembly according to claim 1, wherein said deformable bag being comprised of a resilient material configured to absorb the impact energy of a golf club without being damaged.

4. The assembly according to claim 2, wherein said granular material fills a void defined between said deformable bag and said lower bounding surface of said recess in said top surface of said golf mat.

5. A golf practice assembly for simulating a bunker shot in the game of golf, said assembly comprising:

a golf mat having a turf portion comprised of artificial turf and a bunker portion comprised of a deformable bag being attached to said golf mat thereby facilitating said bunker portion to simulate sand in a bunker of a golf course wherein said bunker portion is configured to facilitate a golfer to practice bunker shots without traveling to a golf course, said golf mat having a top surface and perimeter edge, golf mat having a recess extending into said top surface, said recess having a bounding edge and a lower bounding surface, said bounding edge undulating around said top surface thereby facilitating said recess to approximate the shape of the bunker of a golf course, said artificial turf being positioned between said bounding edge of said recess and said perimeter edge of said golf mat, said deformable bag having a perimeter edge and an upper surface, said perimeter edge of said deformable bag being attached to said lower bounding surface of said recess having said perimeter edge being aligned with said bounding edge of said recess such that said upper surface abuts said bounding edge, said deformable bag being comprised of a resilient material configured to absorb the impact energy of a golf club without being damaged; and a granular material being disposed within said deformable bag thereby facilitating said deformable bag to simulate sand in the bunker of the golf course wherein said granular material is configured to increase difficulty for the golfer to practice the bunker shots, said granular material filling a void defined between said deformable bag and said lower bounding surface of said recess in said top surface of said golf mat.

* * * * *